United States Patent [19]

Dean, II

[11] Patent Number: 4,469,028

[45] Date of Patent: Sep. 4, 1984

[54] PRIMARY SUSPENSION SYSTEM FOR A RAILWAY CAR WITH VERTICAL AND LONGITUDINAL COMPLIANCE

[75] Inventor: Walter C. Dean, II, Collegeville, Pa.

[73] Assignee: The Budd Company, Troy, Mich.

[21] Appl. No.: 335,249

[22] Filed: Dec. 28, 1981

[51] Int. Cl.[3] ..... B61F 5/06; B61F 5/30; B61F 15/02

[52] U.S. Cl. ..... 105/224 R; 105/218 A; 105/453; 267/3; 267/54 R

[58] Field of Search ..... 105/218 A, 218 R, 224 A, 105/224 R, 224.1, 453; 267/3, 54 R

[56] References Cited

U.S. PATENT DOCUMENTS

| | | | |
|---|---|---|---|
| 44,027 | 8/1864 | Toshach | 267/3 |
| 1,776,261 | 9/1930 | Kreissig | 267/3 |
| 2,762,316 | 9/1956 | Coskun | 105/224 R X |
| 2,874,647 | 2/1959 | Candlin, Jr. | 105/453 |
| 2,934,334 | 4/1960 | Davis | 105/224 R |
| 3,658,312 | 4/1972 | Scheublein et al. | 267/54 R |
| 4,125,276 | 11/1978 | Levasseur | 267/54 R |

FOREIGN PATENT DOCUMENTS

| | | | |
|---|---|---|---|
| 634396 | 8/1936 | Fed. Rep. of Germany | 105/224 R |

*Primary Examiner*—Robert B. Reeves
*Assistant Examiner*—Howard Beltran
*Attorney, Agent, or Firm*—Edward M. Farrell; Herman Foster; Thomas I. Davenport

[57] ABSTRACT

A primary suspension system for a railway car comprises one or more leaf springs configured to provide vertical and horizontal portions for vertical and longitudinal compliance. A portion of the leaf spring is curved to wrap around a portion on the wheel journal bearing and rest on the top thereof.

5 Claims, 4 Drawing Figures

PRIMARY SUSPENSION SYSTEM FOR A RAILWAY CAR WITH VERTICAL AND LONGITUDINAL COMPLIANCE

BACKGROUND OF THE INVENTION

In a railway car, primary and secondary suspension systems are generally employed. The primary suspension system refers to the suspension between the journal bearing assemblies and the truck frame. The journal bearing assemblies carry wheel-axle units and acceleration forces generated by the wheels riding over the rails. These forces are transmitted through the primary suspension system to the side frames of the truck. The secondary system refers to the suspension system between a bolster on the car body and the truck and may include air or mechanical springs, for example. The present invention is directed to primary suspension systems.

There are presently in use railway cars in which the primary suspension system includes rubber so-called shock rings fitted between a journal bearing assembly and side frames of the truck. The rubber rings used are compressed and clamped between the journal assemblies and side frame.

Very often such rings result in high vertical and longitudinal stiffness. Relatively high vertical stiffness in the primary suspension systems results in very little attenuation of the wheel accelerations to the truck frame. The relatively high longitudinal stiffness tends to maintain the axle position or wheel base within the truck frame limiting the extent to which the axles can steer while curving.

While the use of rubber rings in primary suspension systems has proven satisfactory in many situations, it has the disadvantage of compression set and aging. The use of rubber in the suspension system generally requires replacements of the rubber elements involved which is undesirable from a long term maintenance point of view.

In addition to limiting the acceleration levels experienced in a truck, it is also desirable for a primary suspension system to have sufficient longitudinal compliance to allow the axles on the truck to self-steer and align themselves properly with the rails, a feature not found in so-called non-spring or rigid systems.

OBJECTS OF THE INVENTION

It is an object of this invention to provide an improved suspension system capable of vertical and longitudinal compliance to reduce acceleration levels for truck mounted equipment and to permit some self steering of axles connected to a railway truck.

It is a further object of this invention to provide an improved suspension system for a railway truck wherein the relative vertical and longitudinal spring rates may be selectively determined by the dimensions of the spring elements.

It is still a further object of this invention to provide an improved mechanical suspension spring with selected vertical and longitudinal spring rates which is light-weight, has long life and involves little maintenance.

SUMMARY OF THE INVENTION

In accordance with the present invention, a primary suspension system having longitudinal and vertical compliance is provided in a railway car which includes a truck with a side frame having a journal bearing for carrying a wheel-axle unit. The suspension system comprises one or more leaf springs. The leaf spring has its ends connected to the side frame and includes horizontal, vertical and curved portions, part of which rests on the journal bearing and extends over, partly around and below the wheel journal bearing.

Other objects and advantages of the present invention will be apparent and suggest themselves to those skilled in the art from a reading of the following specification and claims, taken in conjunction with the accompanying drawings.

DETAILED DESCRIPTION OF THE PREFERRED EMBODIMENTS

Figure 1:
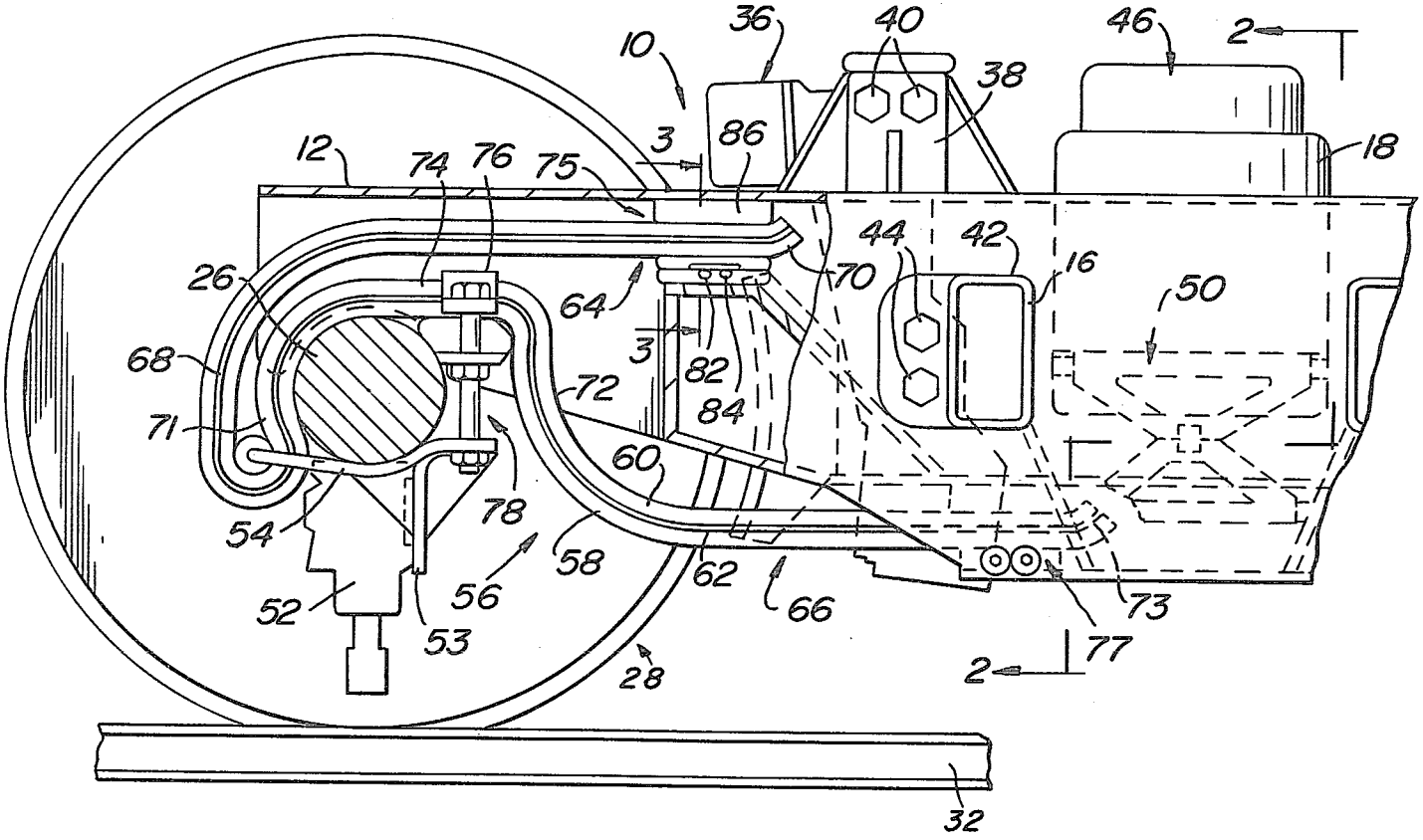
FIG. 1 is a partial side view, partly in cross-section, illustrating a suspension system mounted on a truck, in accordance with the present invention.
Figure 2:
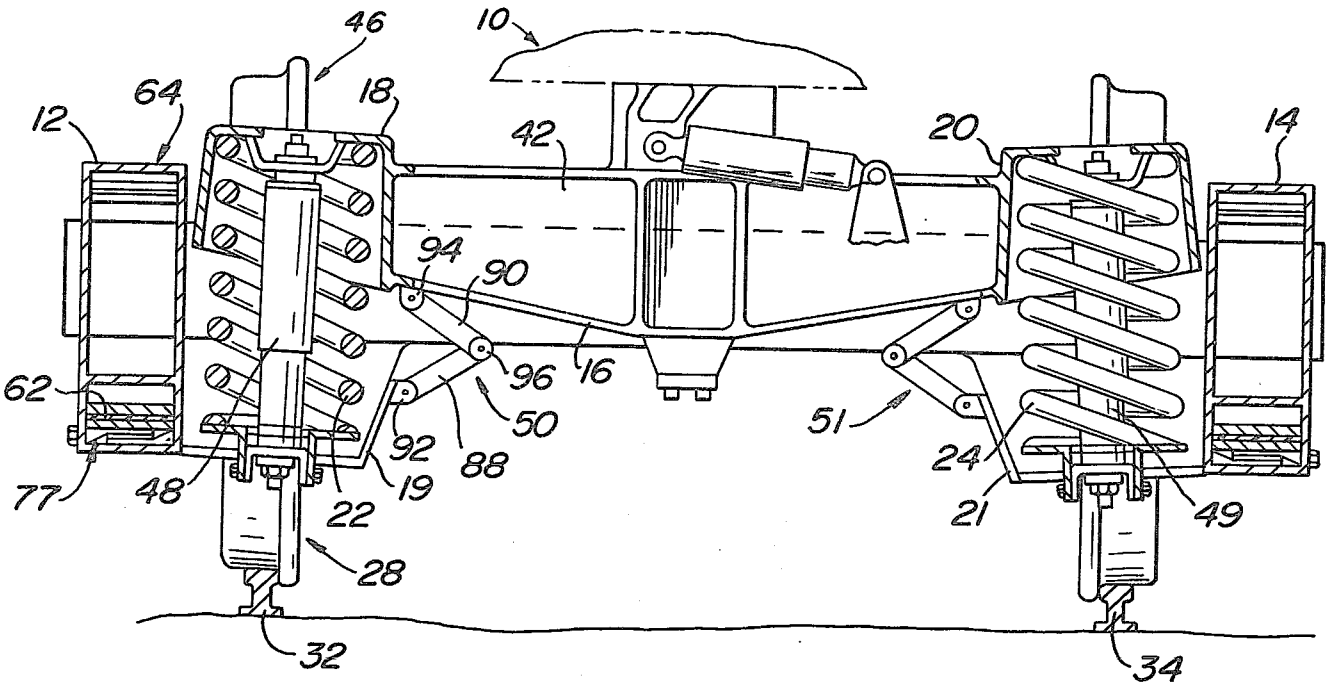
FIG. 2 is a cross-sectional view taken along lines 2—2 of FIG. 1.

Referring to FIGS. 1 and 2, portions of a typical railway truck are illustrated. Some of the details relating to such trucks are conventional and therefore will not be illustrated or described in detail. A typical truck may include spring pockets on a pair of side frames which support the secondary suspension system and shock absorber. The side frames themselves may be interconnected by two rectangular tubular members which support traction motors. A center bolster transmits the weight of the car from a vertical center post to the top end of the secondary suspension springs and shock absorber. Lateral motion is controlled by the secondary stops, lateral shock absorbers and rubber travel stops. Longitudinal motion between the bolster and the side frames is controlled by suitable means generally involving vertical sliding members. In the present invention, the longitudinal motion between the bolster and the side frames is controlled by a novel arm arrangement at each secondary suspension spring pocket, as will be described in detail.

The present invention is directed primarily to the primary suspension system which involves the use of a leaf spring. A truck 10 comprises a pair of side frames 12 and 14 and a bolster 16. The bolster includes a pair of spring seats 18 and 20 which include mechanical springs 22 and 24 and shock absorbers 48, 49, respectively. The spring seats 18 and 20 are disposed within the bolster 16. A corresponding pair of spring seats 19 and 21 are disposed within the side frames 12 and 14, respectively. The mechanical springs 22 and 24 comprise parts of the secondary suspension system for the truck 10.

Journal bearings, such as the journal bearing 26 illustrated in FIG. 1, are disposed within the truck to hold wheel-axle units, such as wheel-axle unit 28. The wheels of the units are disposed to ride on rails 32 and 34.

Various other elements are illustrated in FIGS. 1 and 2 which are not directly related to the invention, but will be mentioned briefly. The brake assembly mechanism 36 is attached to a member 38 by means of bolts 40 and to the side frame 12 by means of bolts 44. The member 38 is attached to the side frame 12. There are generally four of these brake assemblies per truck. A straight rectangular tube 42 extends from one side frame all the way across to the other side frame. There are generally two of these tubes, one in the front and one behind the center line of the truck. These tubes extend through both the inner and outer faces of the side frames 12 and 14 in order to provide rigid attachment. The tubes also support the gear box and the motors which are used to drive each axle.

Apparatus 46 comprises the spring tower area that includes the spring seat 18, shock absorber 48 and mechanical spring 22. As illustrated in FIG. 2, the shock absorbers 48 and 49 and the mechanical springs 22 and 24 are slightly angled inwardly.

Longitudinal reaction elements 50 and 51 are provided to permit traction and braking forces from the truck to be transmitted longitudinally up into the bolster 16. The vertical and lateral components of the load are not reacted by these elements. The longitudinal reaction elements 50 and 51, as will be fully described in detail, are specifically designed not to resist vertical or lateral motion so that the coil springs and the rubber bumpers (not illustrated) that are incorporated elsewhere in the truck will take up the load. The traction and braking forces have to be transmitted from side frames 12 and 14 into the bolster 16 in order to propel or brake the car and in the past this has been done by means of a vertical sliding surface which is a wear surface and is a maintenance problem.

Trip cock apparatus 52 is connected to a connecting element 53 and hangs down away from the journal retainer 54. While this is not related to the invention, it is important that the trip cock associated with the wheel-axle unit actually follow the wheels up and down and are not part of the suspension system. The apparatus 52 is part of an automatic braking system to sense a particular protrusion that comes up from the track and trips a valve to prevent the train from going beyond a certain point. This may be part of the control system in the train and may include air valves.

The primary suspension system relating to the present invention comprises a leaf spring or active element 56. The leaf spring 56 may include one or more leaf spring elements. In the embodiment illustrated, the leaf spring 56 includes a pair of leaf springs 58 and 60 having a wear liner 62 disposed therebetween to provide damping. The liner may be nylon or other similar suitable material having lower wear and friction characteristics than the metal leaf springs. While a single spring could be used, it would be undamped. Three or more leaf springs could also be used. However, this would add unnecessarily to the manufacturing complexity of the suspension system.

The leaf springs 58 and 60 are formed in the shape illustrated in FIG. 1 from two continuous strips of high strength leaf spring steel. In this shape, they provide vertical and longitudinal compliance to provide the vertical and longitudinal spring rates in the suspension system. The vertical spring rate is determined by the length of the horizontal portions of the springs 64 and 66 and of the curved portions 68 and 72. The longitudinal spring rate is determined by the vertical portions 68 and 72 of the curved part of the spring. The springs 58 and 60, which may be considered as a single unit, includes horizontal portions 64 and 66. Vertical portions 68 and 72 are also formed in the spring as the spring turns around the journal 26. The vertical portion 71 and the top portion 74 rests on the journal bearing 26.

The leaf spring rests on top of the journal bearing 26 and is secured in place by means of the journal retainer 54, a strap arrangement 76 and a bolt arrangement including a bolt 78.

In the configuration shown, the load is distributed effectively from the truck side frame 12 to the journal bearing 26 on the axle of the wheel-axle unit through two equal load bearing paths. The first path is formed by a top and downward curved dual leaf and the other path is formed by the bottom and upward curved dual leaf.

Because the leaf spring arrangements used on the four corners of the truck are similar, only the one related to one end of the side frame 12 will be described, it being understood that the arrangement relating to the other end of the side frame 12 and both ends of the side frame 14 is similar.

Figure 3:
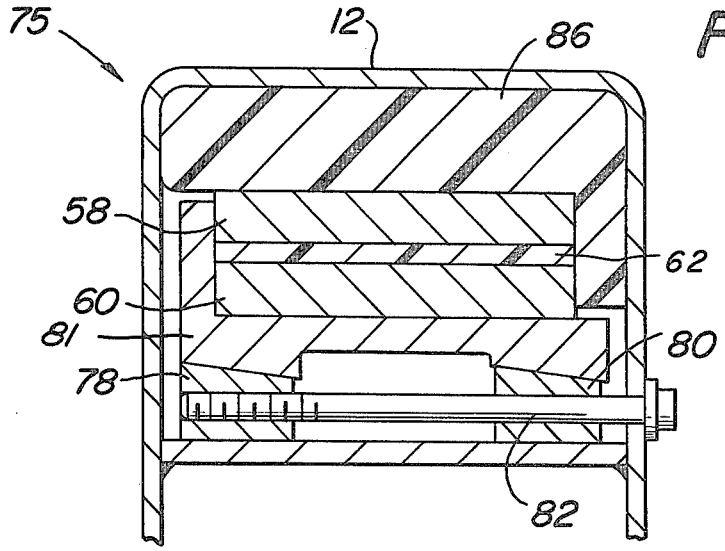
FIG. 3 is a cross-sectional view taken along lines 3—3 of FIG. 1.

The two ends 70 and 73 of the leaf spring 56 are connected to the side frame 12 through similar connecting means 75 and 77, one such connecting means 75 being illustrated in detail in FIG. 3. The two leaf springs 58 and 60 and liner 62 are clamped firmly into a corner of the side frame 12 by wedge blocks 78 and 80. The wedge blocks 78 and 80 are attached to bolts 82 and 84. The wedge blocks are forced by the bolts against the clamping block 81 and portions of the side frame 12 securing the springs 58 and 60 and liner 62 to the side frame. The upturned ends 70 and 73 of the springs 58 and 68 prevent dislodging of the springs in the event that the clamping bolts loosen. A spacer member 86 is provided between the springs and the side frame 12.

In a particular embodiment of the present invention, the particular requirements for spring rates were 30,000 pound per inch in the longitudinal direction and 10,000 pounds per inch in the vertical direction. This 3:1 spring ratio is achieved by proportioning the various horizontal and vertical portions including the turns in the leaf springs. The horizontal portions 64 and 66 attached to the side frame provide the vertical compliance. The upturned portions 68 and 72, leading and trailing the axle, offer the longitudinal compliance. By varying the lengths of these portions, the ratio of the vertical to longitudinal compliance may be varied.

In the embodiment illustrated, one continuous strip of steel for each leaf spring is used. In some cases one continuous band of steel may be used for the entire side of a truck to encompass journal bearings at the front and rear of the truck on one side. In this case, the spring would be connected to the side frame towards its center.

The leaf springs may be varied in width or thickness or a combination in order to maintain a relatively constant stress spring. A typical spring may be 6 inches wide and close to three quarters of an inch thick. The thickness should be greater at the anchor points. The width may reduce to about two inches above the journal bearing and then widen to 6 inches where sharp bends are made going around the journal bearing.

Figure 4:
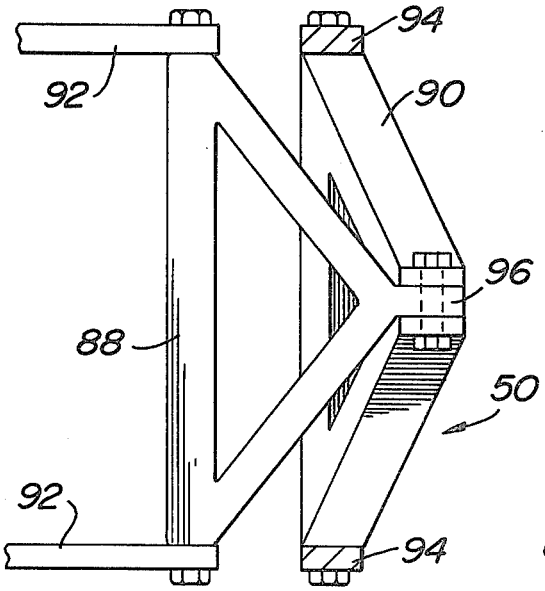
FIG. 4 is an isometric view of one of the elements used in the present invention.

Referring to FIG. 4, details of the longitudinal reaction means 50 is illustrated. A pair of "A" shaped arms 88 and 90 connected through pivot connection 96 each include a pair of extensions or arms which are connected to pivot points 92 and 94, respectively. The pivot connections 92 and 94 are connected to lower ends of the spring cup 18 (FIG. 2) which is part of the side frame 12 and the arm 88. The arm 90 is connected to pivot connections 94 which are connected to the bolster 16 (FIG. 2).

The way this arrangement works is that the longitudinal force coming from the side frame 12 is transmitted out through the spring receptacle 18 to pivot connections 92, goes up through the lower arm 88, through pivot connection 96, back up through the second arm 90 to pivot connections 94 which are on the bolster 16. The vertical, lateral and roll movements are unrestricted by this arrangement because pivots 92, 96 and 94 act in rotation and similarly lateral motion is taken out with those pivot points rotating. But when the side frames try to move longitudinally with respect to the bolster, they cannot do so because the wheel base at pivot connections prevent relative motion in the longitudinal direction.

What is claimed is:

1. A primary suspension system to provide vertical and longitudinal compliance for a railway car having a journal bearing for supporting a wheel-axle assembly and a side frame comprising:

(a) a pair of elongated leaf springs each connected at one end to the top portion of said side frame and each connected at its opposite end to the bottom portion of said side frame;

(b) an elongated liner element disposed between said pair of springs to provide damping;

(c) said leaf springs comprising a plurality of horizontal and curved vertical portions on both sides of said journal bearing;

(d) said horizontal portions providing said horizontal compliance with the horizontal spring rate being determined by the length of said horizontal portions;

(e) said curved vertical portions on both sides of said journal bearing providing said longitudinal compliance with the longitudinal spring rate being determined by said curved vertical portions, and (f) said leaf springs being disposed on the top portion only of said journal bearing.

2. A primary suspension system as set forth in claim 2 wherein each of said leaf springs comprise continuous strips of high strength metal material providing vertical and longitudinal spring rates for said primary suspension system.

3. A primary suspension system as set forth in claim 2 wherein said horizontal portions of said leaf springs comprise first horizontal portions higher than said journal bearing and second horizontal portions lower than said journal bearing, and said vertical portions comprise curved portions on opposite sides of said journal bearing.

4. A primary suspension system as set forth in claim 3 wherein said leaf springs are curved around the top and two sides of said journal bearing and a bearing retainer member is connected below said journal bearing to maintain said leaf springs in position around said journal bearing.

5. A primary suspension system as set forth in claim 1 wherein the ends of said leaf springs are secured to said side frame by connecting means including wedge blocks and clamping bolts, with the ends of said leaf springs being upturned to prevent dislodging of said springs in the event that said clamping bolts loosen.

* * * * *